United States Patent [19]

Witt et al.

[11] 4,164,284

[45] Aug. 14, 1979

[54] LIQUID CONTAINER NOVELTY

[76] Inventors: Frank Witt, 57 Poplar St., Trumbull, Conn. 06611; Stephen Semanchik, 9-D Fairfield Condominiums, Bridgeport, Conn. 06606

[21] Appl. No.: 855,187

[22] Filed: Nov. 28, 1977

[51] Int. Cl.[2] ..... B65D 11/16

[52] U.S. Cl. ..... 206/217; 215/12 A; D7/77

[58] Field of Search ..... 206/217; 215/12 A, 13 R; D24/47, 48; D7/77; D34/4 A

[56] References Cited

U.S. PATENT DOCUMENTS

| | | | |
|---|---|---|---|
| D. 201,336 | 6/1965 | Nelson | D24/47 |
| D. 212,921 | 12/1968 | Bloomberg | D24/47 |
| 2,442,056 | 5/1948 | Montgomery | 215/13 R |
| 2,695,719 | 11/1954 | Faris | 215/13 R |
| 3,285,450 | 11/1966 | Piker | 215/13 R |
| 3,341,045 | 9/1967 | Sandler | 215/13 R |
| 3,356,243 | 12/1967 | Piker | 215/13 R |
| 3,469,739 | 9/1969 | Phillips | 215/13 R |

FOREIGN PATENT DOCUMENTS

| | | | |
|---|---|---|---|
| 984528 | 2/1951 | France | 215/13 R |

*Primary Examiner*—Herbert F. Ross
*Attorney, Agent, or Firm*—Arthur T. Fattibene

[57] ABSTRACT

A container novelty having complementary outer shell portions simulating a portion of a predetermined shape having disposed therein a container for containing a beverage in spaced relationship to the internal walls of the respective shell portion and a cap shaped to complement the remainder portion of the predetermined shape detachably connected to the container. An insulating material is disposed in the space between the shells and the container disposed therebetween. In another form of the invention, the novelty is utilized as a housing for a radio.

7 Claims, 12 Drawing Figures

LIQUID CONTAINER NOVELTY

OBJECTS

An object of this invention is to provide a container novelty in which the container assumes a predetermined shape.

Another object is to provide a container which is relatively simple in construction, can be inexpensively fabricated, and which is positive in operation.

Another object is to provide a novelty container which defines a housing for a radio.

BRIEF SUMMARY OF INVENTION

The foregoing objects and other features and advantages are attained by a novelty container which comprises a pair of complementary shell portions shaped to define a portion of a predetermined novelty shape and having disposed therein a bottle or container which is maintained in spaced relationship to the internal surface of the assembled shell portion. The container includes a body portion complementing the internal shape of the shell portions and is keyed or maintained fixed relative to the shell portions so as to be maintained in relatively fixed relationship thereto. An insulating medium is disposed in the spacing between the container and circumscribing shell portions. A cap having a shape complementing the shell portions is detachably connected to the container which functions as a closure for the container and which forms the remainder portion of the predetermined novelty shape. Hanging straps are connected to the container novelty to facilitate the carrying thereof. In another form of the invention, the shells define a housing for a radio.

FEATURES

A feature of this invention resides in the provision wherein a novelty container is composed in part of complementary shell portions to define a portion of a predetermined novelty shape having a container body fixed therein and having a closure detachably connected to the neck portion of the container which defines the remaining complementary portion of the predetermined shape.

Another feature resides in the provision of a novelty shell or container which can be readily manufactured and assembled with a minimum of time and effort.

Other features and advantages will become more readily apparent when considered in view of the drawings and specification in which.

DETAILED DESCRIPTION

Figure 1:
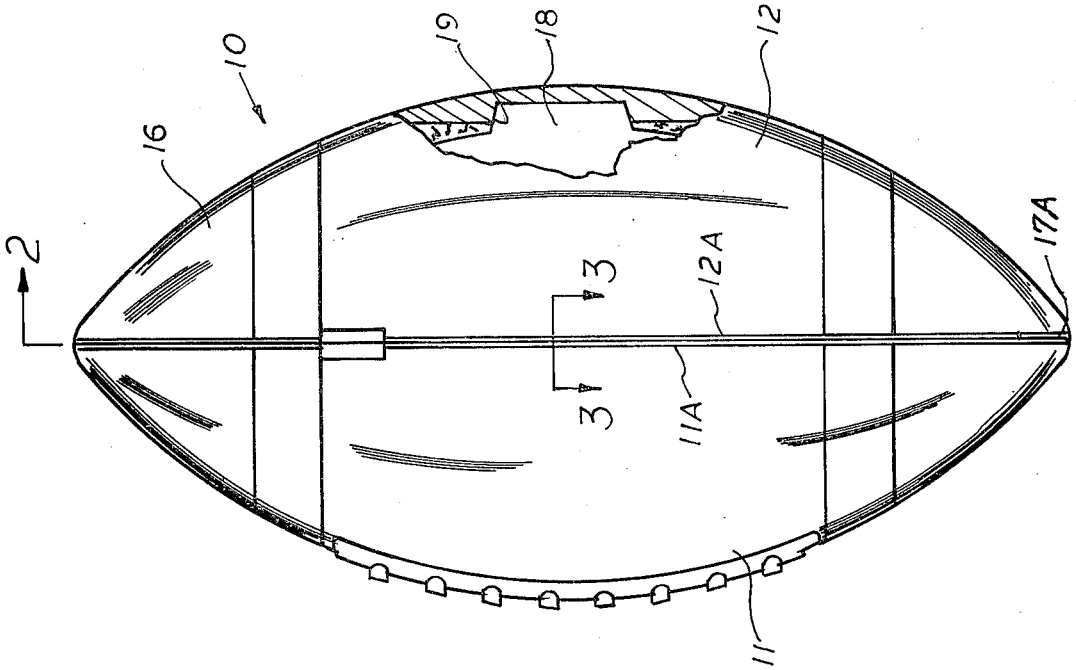
FIG. 1 is a side elevation of a novelty container embodying the present invention having portions thereof broken away.

Referring to the drawings, there is shown therein a novelty container 10 embodying the present invention. In the illustrated form of the invention, the novelty container is constructed so as to simulate a football, which shape is keeping in theme with a football sporting event. However, it will be understood that the container configuration embodying the invention to be herein described may assume any particular external or novelty configuration so as to maintain a theme of such sporting events as baseball, basketball, soccer, tennis, etc. In accordance with this invention, the novelty container comprises a pair of complementary shell portions 11, 12 which define the major portion of a predetermined shape, e.g., a football as illustrated in FIGS. 1 and 2.

Figure 3:
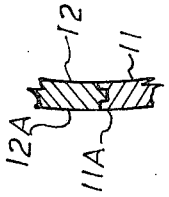
FIG. 3 is a detail of construction taken along line 3—3 on FIG. 1.

The respective shell portions 11 and 12 each have a complementary inter-locking edge portion 11A, 12A. As best seen in FIG. 3, the respective complementary edge portions of the shells are defined so as to provide for an inter-locking tongue and groove arrangement. Thus one shell 12 may be provided with a projecting tongue extending along the longitudinal edge thereof; and the other shell 11 may be provided with a complementary recess for receiving the tongue as best seen in FIG. 3.

Figure 4:
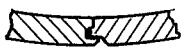
FIG. 4 is a modified detail of construction.

FIG. 4 illustrates a modified means whereby the shell portions 11, 12 can be inter-locked or inter-fitted one to the other. As best seen in FIG. 4, the respective shell portions may be interconnected by a stepped type joint. For positive connection, the respective shell sections can be further bonded together as for example, by ultrasonic welding or solvent bonding.

Figure 2:
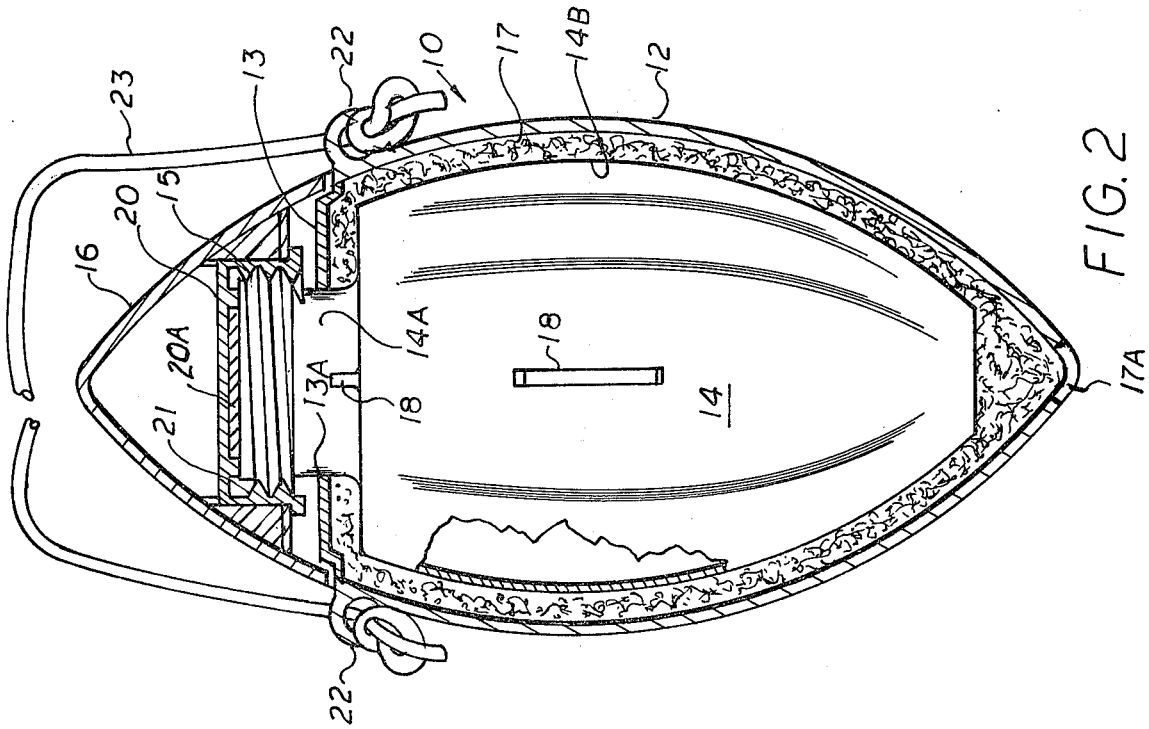
FIG. 2 is a cross sectional view of the novelty container of FIG. 1 taken along line 2—2 thereof.
Figure 5:
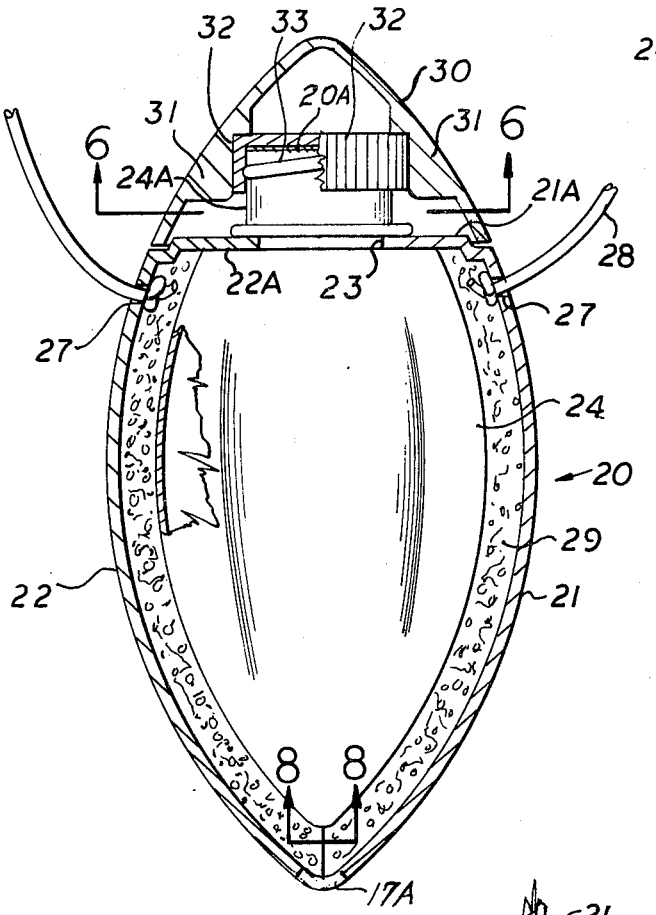
FIG. 5 is a sectional view of a modified embodiment.
Figure 6:
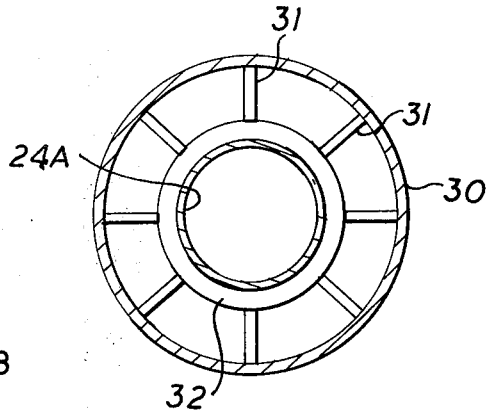
FIG. 6 is a section view taken along line 6—6 on FIG. 1.

As best seen in FIG. 2, the upper ends of the respective shell portions are defined by an inturned flange 13. Respective inturned flanges 13—13 are provided with a cut-out portion 13A so as to define an opening for receiving the neck portion 14A of a container 14 as will be hereinafter described.

Disposed within and between the assembled shells portions 11, 12 is a container 14 which comprises a container body 14B having a configuration which substantially simulates the shape of the internal surfaces of the respective shell portions 11, 12. Connected to the body portion 14B of the container is a neck portion 14A. In the illustrated embodiment, the neck portion 14A of the container 14 is provided with a series of external threads 15 for receiving a closure or cap 16 as will be hereinafter described.

As seen in FIG. 2, the container body 14B is disposed in spaced relationship to the internal surface of the respective shell portions 11, 12. Accordingly, a suitable insulating material 17 is interposed in the spacing between the container body 14B and the outer shell portions 11, 12. In the illustrated embodiment, the insulating material, preferably comprises foamed polyurethane, which may be formed in situ in the space between the container body 14B and the outer shell portions 11, 12. As best seen in FIGS. 1 and 2, the container 14 is formed with one or more laterally extending keys 18 which are adapted to be received in a recess 19 formed on the internal surface of the shell portions 11 or 12. A vent opening 17A is provided in shell portion 12 at the seam portion 12A for venting any gases generated during the foaming of insulation 17.

With the structure thus far described it will be apparent that the assembly of the outer shells 11, 12 to the container 14 can be readily attained simply by bringing the respective shell portions 11, 12 together about the container 14 contained therebetween in a manner whereby the keys 18 are oriented with the recess 19 formed in the respective shell portions. Thus the opening 13A defined in the upper flanges 13 closely embrace the circumferential portion of the container neck portion 14A. It will be understood that the respective shell portions 11, 12 can be frictionally retained in the assembled position by the tongue and groove connection 11A, 12A. However, to provide a more positive connection of the respective shell portions 11, 12, a fusion or ultrasonic welding of the two sections 11, 12 can be readily effected along the abutting longitudinal edge portions thereof. With the shell portions 11, 12 thus assembled and secured to the container body, foamed polyurethane 17 with the appropriate blowing agents can be introduced into the spacing between the container body 14B and the outer shell 11, 12 so as to fill the spacing therebetween with a thermal insulating material.

The closure 16 for the container comprises a cap which is shaped to complement the remainder portion of the predetermined container shape. In the illustrated form of the invention, the closure 16 comprises the tip end of the football shape. Connected to the closure 16 internally thereof is a cap 20 with seal 20A and having internal threads 21 which are adapted to complement the external thread 15 of the container neck portion 14A. It will thus be noted as best seen in FIG. 2, that with the closure 16 in the assembled position, the same completes the predetermined football shape. Thus the closure 16 is rendered detachably connected to the neck portion 14A of the container in a manner to seal the container, and also to complete the predetermined outer shape.

As best seen in FIG. 2, the shell portions 11 and 12 are provided with a pair of aperture ears or lugs 22 through which the ends of a belt or strap 23 are fastened. Thus, the strap 23 can be utilized to facilitate the carrying of the novelty container described and/or whereby the novelty container 10 may be worn about one's neck when one is participating as a spectator at a particular sporting event.

The complementary keys 18 and recesses 19 formed between the container body 14A and the outer shells will prohibit any relative movement between the container 14 and the shells 11, 12 when the closure is threaded and unthreaded relative to the neck portion of the container.

From the foregoing, it will be noted that the defined structure provides for a relatively simple and appealing container, which can be readily fabricated and constructed for the minimum of effort and at relatively low cost, since the respective component parts can be readily formed of readily molded material, such as plastic and the like. Also, due to the insulating barrier which is developed in situ, the container can be used for either hot or cold beverages wherein the respective temperatures of the beverages contained therein can be maintained over a considerable period of time.

FIGS. 5 to 8 illustrate a modified embodiment. In this form of the invention, the novelty container 20 is defined by a pair of complementary shell portions 21, 22. As shown, shell portions 21 and 22 define the major portion of a predetermined shape, which in the illustrated embodiment comprises a football shape. The upper ends of the respective shells 21 and 22 is formed as an inturned flange 21A, 22A. As hereinbefore described, the inturned flanges 21A and 22A have a cutout portion so that in the assembled position, the flanges define an opening 23 for receiving the neck end 24A of a container or bottle 24. It will be noted that the bottle or container is shaped to complement the internal surfaces of the respective shell portions 21 and 22 and is spaced therefrom to define a space 29.

Figure 8:
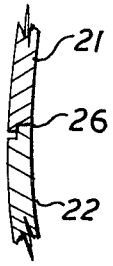
FIG. 8 is a section view of the joint connection taken along line 8—8 on FIG. 5.
Figure 7:
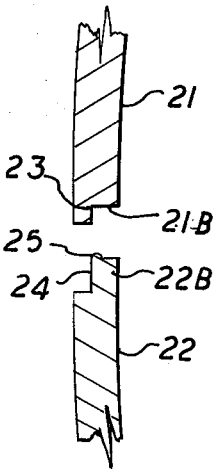
FIG. 7 is a detail of construction shown in an exploded view of step joint prior to connecting the shell sections.
Figure 9:
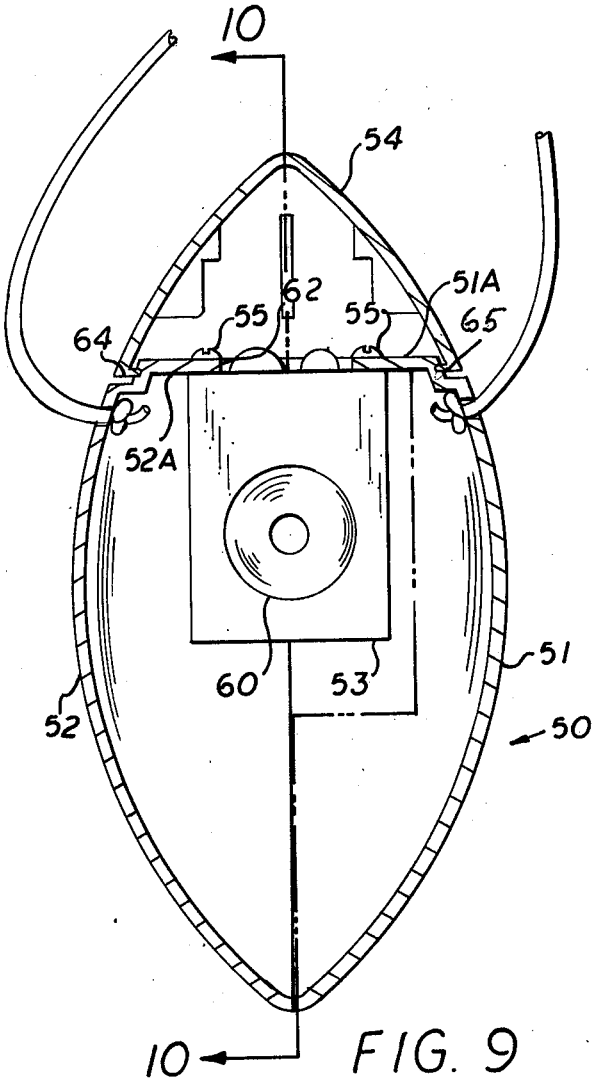
FIG. 9 is a section view of another modified embodiment.
Figure 10:
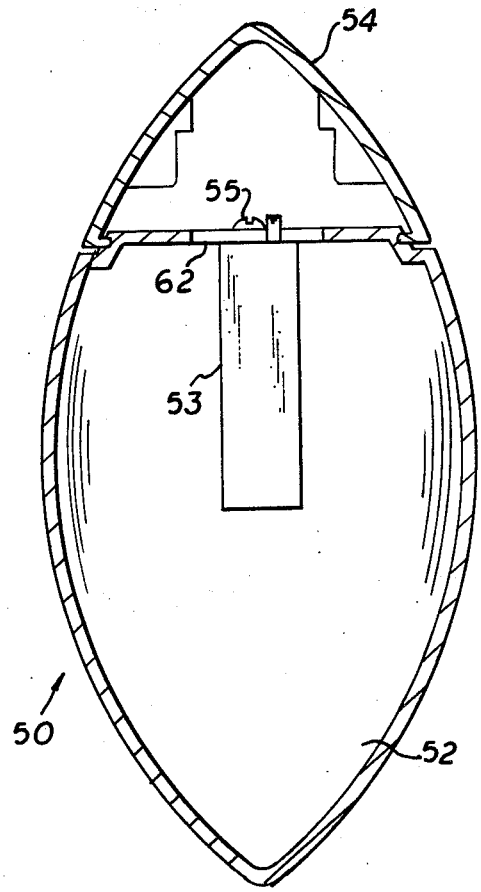
FIG. 10 is a section view taken along line 10—10 on FIG. 9.

The respective edge portions 21B and 22B are formed to define complementary step joint to provide a fusion stepped seam in the assembled position. Referring to FIGS. 7 and 8, shell 21 has an edge which is undercut as at 23 adjacent the inner surface thereof to define a step. The other shell 22B is undercut adjacent the outer surface thereof as at 24. It will be noted that the undercut at 24 is slightly greater in length than step 23. Also one of the edges, e.g., edge 22B is provided with a bead 25, which during a fusing operation fuses into the seam 26 as best seen in FIG. 8.

In this form of the invention, the respective shells 21 and 22 have a hole 27 for receiving the ends of a hanger strap or cord 28. As shown, the ends of the cord 28 are knotted to retain the strap or cord 28 to its corresponding shell portion. The space 29 between the shells 21, 22 and the bottle or container 24 is filled with an insulating material, e.g., polyurethane foam. With the polyurethane foam expanded in situ within space 29, the expansion thereof will exert a pressure on the container 24 so as to fix it against rotation relative to the outer shells 21, 22. Also the polyurethane, expanded foam, secures or fixes the ends of the hanger strap 28 in place. A vent 17A is provided as hereinbefore described.

The cap portion 30 is shaped to complete the configuration of the predetermined shape, e.g., in the illustrated embodiment a football. Circumferentially spaced about the inner surface of the cap 30 are a series of radial vanes or fins 31. The respective vanes 31 are undercut or notched out as at 32 for firming or receiving of a closure or top 32 with seal 20A which is arranged to be detachably secured to the neck 24A of the bottle or container 24. As shown the outer periphery of the top 32 are provided with a series of serrations whereby the top 32 can be frictionally secured between ribs or vanes 31 so as to prevent any relative rotation therebetween.

In the illustrated embodiment, the top or closure 32 is internally threaded so as to accommodate the external threads 33 on the neck 24A of the bottle 24. From the foregoing, it will be noted that the cap can be readily threaded and unthreaded. In all other respects the container of FIGS. 5 to 8 functions as hereinbefore described with respect to FIGS. 1 to 4.

FIGS. 9 to 12 illustrate a modified embodiment. In the embodiment of the novelty 50 of these figures, the predetermined shape, i.e., the shape defined by complementary shell portions 51 and 52 define a housing for accommodating a device other than a bottle or container. In this form of the invention, shell portions 51 and 52 define a housing for accommodating a radio 53. Shell portions 51 and 52 like shell portions of FIGS. 1 and 5 terminate in a top flange portions 51A, 52A. Shell portions 51 and 52 are essentially similar to that described with respect to FIGS. 5 to 8.

The cap portion 54 is also constructed similar to that described in FIGS. 5 to 8. However, in this form of the invention, the top or closure for the container is not utilized. In these forms of the invention, the cap 54 and the upper end of the lower shell portions 51 and 52 circumscribing the flanges 51A, 52A are provided with complementary locking means so that the cap can be detachably secured to the lower shell portions 51, 52.

Figure 11:
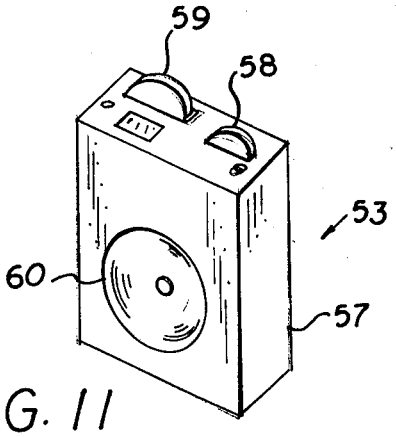
FIG. 11 is a perspective view of a radio adapted for use in the embodiment of FIGS. 9 and 10.
Figure 12:
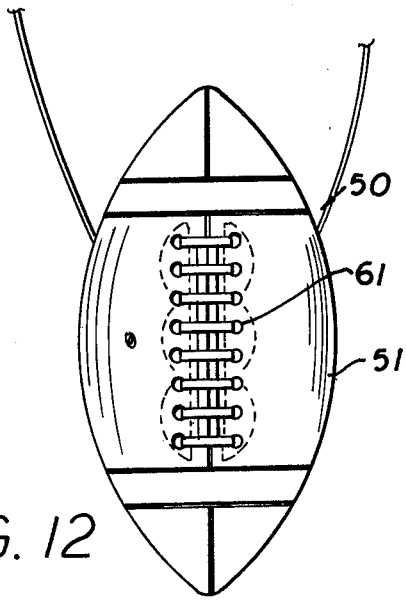
FIG. 12 is an external front view of the embodiment of FIGS. 9 and 10.

Secured to the under surface of flanges 51A, 52A is a radio 53. The radio is secured thereto by a pair of spaced fasteners 55, e.g., screws, rivets or the like. As best seen in FIG. 11, the radio comprises an outer housing 57 in which the control, e.g., volume on-off switch 58 and station dial 59 are located on the top of the radio housing 57. The speaker 60 is disposed to one side of the housing 57, and opposite the holes 61 formed in shell 51. As best seen in FIG. 12, the holes 61 extend through the thickness of shell 51 to define an opening through which the sounds of the radio can eminate. The holes 61 also simulate the simulated holes of the football lacing design as indicated in FIG. 12.

The arrangement is such that the controls, that is, dials 58, 59 extend into the hole 62 defined by flanges 51A, 52A.

From the foregoing it will be noted that the shells 51, 52 define a unique housing for a radio. Thus the shell portions of novelty 50 are similar to that of novelty 20, and can be adapted to accommodate either a bottle or container 24 or a radio 53. As illustrated, the embodiment of FIG. 9 may be slightly modified to provide a friction snap fit between the lower ball section as defined by shells 51, 52 and the cap 54. This is evidenced by an inturned rim 64 complementing a groove 65 circumscribing the flange portions 51A, 52A. It will be understood that the embodiment of FIGS. 5 to 8 may also be so formed.

While the foregoing invention has been described with respect to various embodiments thereof, it will be readily understood and appreciated that variations and modifications may be made without departing from the spirit or scope of the invention.

What is claimed is:

1. A liquid container comprising:

a pair of complementary outer rigid shells defining a major portion of a predetermined simulated ball shape, said shells each having complementary interlocking edge portions and each of said shells having an inturned integrally formed flange portion, said inturned flanges defining an opening, a container having a body portion and a connected neck portion, said body portion complementing the shape of said outer shells, and said body portion being spaced from said shells internally thereof, said neck portion extending through said opening defined by said flanges, said body portion of said container having protruding keying means formed thereon and said shells having complementary recess keying means formed in the inner surface of said shells for fixing said container relative to said outer shells so as to prohibit relative rotation therebetween, a cap, said cap having a shape to define the remaining complementary portion of said predetermined ball shape, a container closure disposed within said cap, said closure and neck portion having complementary means for detachably connecting said closure to said neck portion whereby in the closed position, the container is sealed and said cap and shells define the total of said predetermined ball shape, thermal insulating means disposed in the space between said container and said shells, means defining a vent opening formed in said outer predetermined shape whereby said thermal insulating means can be formed in situ within the space between said outer shell and container therein, and a flexible hanger strap connected to said shells.

2. A liquid container as defined in claim 1 wherein said predetermined shape is a football.

3. A liquid container as defined in claim 1 wherein said cap includes a plurality of circumferentially spaced ribs, and said container closure being secured to said ribs.

4. A liquid container as defined in claim 3 wherein each of said ribs are undercut, and said container closure having a series of serrations spaced thereabout, said serrations being secured to said ribs so as to prevent relative rotation between said container closure and said cap.

5. A liquid container as defined in claim 1 wherein each of said shells having an opening formed therein, a hanger strap whereby the ends of said strap extend in the opening in said shells.

6. A novelty device comprising:

a pair of complementary rigid outer shells to define a major portion of a predetermined ball shape, said shells having complementary edge engaging portions, each of said shells having an inturned flange adjacent an end thereof, said flanges defining an opening, a radio, means for dependingly securing said radio to the underside of said flanges, said radio having control means disposed in alignment with said opening, said radio having a speaker in one side thereof, one of said shells having a series of openings formed thereon, said speaker being disposed adjacent said holes, whereby the sounds of said radio eminate through said holes, said sound holes forming an integral part of a simulated ball design on the outer surface of said shells, and a cap, said cap having a shape to define the remaining complementary portion of said predetermined ball shape, and said cap and said shells having complementary means for detachably securing said cap to said shells, means for hanging said novelty device.

7. A novelty device as defined in claim 6 wherein said predetermined shape comprises a football shape.

* * * * *